US007631826B2

(12) United States Patent
Tamura et al.

(10) Patent No.: US 7,631,826 B2
(45) Date of Patent: Dec. 15, 2009

(54) CRUSHING APPARATUS

(75) Inventors: Masataka Tamura, Orange House 103, 104-3, Mukaijima Suitagawara-cho, Fushimi-ku, Kyoto-shi, Kyoto 612-8124 (JP); Masayasu Kurachi, Aichi (JP); Hisanori Yamashita, Aichi (JP); Atsushi Takahara, Aichi (JP)

(73) Assignees: Masataka Tamura, Kyoto-shi, Kyoto (JP); Yutaka Mfg. Co., Ltd., Kounan-shi, Aichi (JP)

( * ) Notice: Subject to any disclaimer, the term of this patent is extended or adjusted under 35 U.S.C. 154(b) by 558 days.

(21) Appl. No.: 10/593,715

(22) PCT Filed: May 10, 2005

(86) PCT No.: PCT/JP2005/008524

§ 371 (c)(1),
(2), (4) Date: Sep. 21, 2006

(87) PCT Pub. No.: WO2006/001126

PCT Pub. Date: Jan. 5, 2006

(65) Prior Publication Data

US 2007/0210196 A1 Sep. 13, 2007

(30) Foreign Application Priority Data

Jun. 23, 2004 (JP) ..... 2004-185082

(51) Int. Cl.
*B02C 7/00* (2006.01)

(52) U.S. Cl. ..... 241/165.5; 241/55; 241/154; 241/92

(58) Field of Classification Search ..... 241/55, 241/92, 154, 165.5
See application file for complete search history.

(56) References Cited

U.S. PATENT DOCUMENTS

| | | | | |
|---|---|---|---|---|
| 2,270,946 | A * | 1/1942 | Hopkins | 241/165.5 |
| 3,966,126 | A * | 6/1976 | Werner | 241/19 |
| 4,087,052 | A * | 5/1978 | Rohrbach | 241/65 |
| 2002/0088882 | A1 * | 7/2002 | Kelsey | 241/30 |

FOREIGN PATENT DOCUMENTS

| | | |
|---|---|---|
| JP | 36 022386 | 11/1961 |
| JP | 05-220375 | 8/1993 |
| JP | 08-60578 | 3/1996 |
| JP | 11 123339 | 5/1999 |
| JP | 2002 027936 | 1/2002 |
| JP | 2003-71307 | 3/2003 |
| JP | 2003 519569 | 6/2003 |

* cited by examiner

*Primary Examiner*—Faye Francis
(74) *Attorney, Agent, or Firm*—Dennison, Schultz & MacDonald

(57) ABSTRACT

A crushing apparatus (10) includes a supplying section (30) for receiving a solid material (M), a crushing section (50) for crushing the material (M) supplied from the supplying section (30), and a discharging section (100) for discharging the material (M) crushed by the crushing section (50) to the outside. The crushing section (50) is formed by partitioning with a first rotating disk (60) and a second rotating disk (70) respectively connected to a first rotating shaft (110) or a second rotating shaft (111). The first rotating disk (60) and the second rotating disk (70) are arranged with pluralities of blades (63, 73) projected from faces thereof opposed to each other and formed with through holes (61, 71) penetrated in an axial direction at positions proximate to a rotational axis center thereof.

18 Claims, 7 Drawing Sheets

CRUSHING APPARATUS

This application is a filing under 35 USC 371 of PCT/JP2005/008524, filed May 10, 2005.

TECHNICAL FIELD

The present invention relates to a crushing apparatus, more particularly, the invention relates to a crushing apparatus for crushing solid materials of various kinds of foods, chemicals, fertilizers, drugs, minerals, metal products, or the like, to constitute powders.

BACKGROUND ART

In a background art, in various fields of industries, it is widely required to crush so as to pulverize solid materials of foods, chemicals, fertilizers, drugs, minerals, metal products, or the like. In these crushing processes by performing a crushing process until a particle shape and a grain size distribution of a powder are within a certain range, for example in the food industry or the drug industry fields, the dissolving rate of a hardly soluble substance may be accelerated or the body absorbing property or the content uniformity in mixing a drug may be promoted. Further, in the mineral industry or the chemical industry fields, the bonding force may be increased in a material formed from compressing during compression molding, or the surface smoothness of a coated product may be improved.

Generally, in the above-described conventional crushing processes, an airflow type or a mechanical type apparatus is utilized. In the former case, a large volume of high-pressure compressed air is injected into a crushing section (where due to the high speed airflow, typically in a sonic velocity range, materials are crushed through impact with one another or a material is crushed through impact with a portion of a peripheral wall surface or the like). According to an airflow type of crushing apparatus, the influence of heat generation is negligible and materials can be crushed into ultra fine particles. However, a large amount of highly compressed air needs to be stably supplied. As a result, the airflow type of crushing apparatus requires a large volume compressor having a high horsepower. Consequently, the initial cost or running cost is increased. The latter type of apparatus is further classified as a rotation impact type of crushing apparatus (e.g., a roll mill, a hammer mill, a pin mill, or the like) or a tumbler type of crushing apparatus (e.g., a ball mill, a vibration mill, or the like). The rotation impact type of crushing apparatus is widely used. According to the rotation impact type of crushing apparatus, a rotating disk, having a blade at an outer periphery thereof, is rotated at a high speed in the crushing section. The crushing process performed by striking the material inputted into the crushing section and impacting the material against a portion of the peripheral wall face or the like. This mechanical type of crushing apparatus can achieve a relatively constant crushing efficiency with a comparatively low running cost.

Further, as an example of a mechanical type crushing apparatus, the technology disclosed in JP-A-2000-042438 is known. According to the disclosure, a rotating grindstone having a grinding and crushing surface is provided at a classifying section located between the crushing section and a discharging section. The classifying gap of the section is narrowly set. Further, the outer peripheral surface of a blade and the peripheral wall face (i.e., liner) of the crushing section are provided with grinding and crushing surfaces in the form of a grindstone. Thereby, the crushing efficiency is improved by intensifying the application of a crushing force with respect to the solid materials.

DISCLOSURE OF THE INVENTION

Problems that the Invention is to Solve

However, according to the conventional crushing apparatus, by increasing the crushing efficiency the finished particle shape of a powder can be very fine or minute. However, the material property of the solid material may be deteriorated as the crushing efficiency is increased. That is, when the application of a crushing force to the solid material is intensified by high-speed rotation of the rotating disk provided in the crushing section, the amount of heat generated in the crushing section is increased. Further, according to a conventional crushing apparatus, even when the solid material is crushed to a desired grain size in the crushing section the powder may stay inside of the crushing section without being discharged. Therefore, for example, when a solid material such as a food, a drug, or the like, is crushed, the solid material may be oxidized by being affected by the heat generated in the crushing process, deteriorating the material properties of protein, fat, amino acid, or the like. Further, excessively crushing a powder deteriorates the rate of recovering a product or a grain size distribution. Especially when a solid material is crushed containing high fat and sugar levels, such as beans, if the solid material is abruptly impacted against the rotating disk being rotated at a high speed in the crushing section thereby causing the application of a large force, the fat or sugar may be scattered from the inside of the material. As a result, the powders may coalesce or adhered to the peripheral wall face or the like. Thereby, the material properties may be damaged.

However, it is not preferable to deal with such problems by reconfiguring, for example, the structure of the whole apparatus with a large-sized and complicated formation, or by additionally installing an exclusive machine to overcome these particular problems. Therefore, it is desired to construct a configuration having a general-purpose performance capable of dealing with many kinds of requests and with the small production amounts prevailing in recent years, without having to reconstitute the total structure of the apparatus using a large-sized and complicated formation.

The present invention has been made in order to overcome the above problem, and the object of the present invention is to improve the crushing accuracy and the product recovery rate without reconstituting the whole structure of a crushing apparatus for crushing solid materials through the use of a large-sized complicated formation and without deteriorating the material properties of the solid material.

Means for Solving the Problems

In order to overcome the above-described problems, a crushing apparatus of the invention adopts the following means.

According to a first aspect of the invention, there is provided a crushing apparatus comprising a supplying section for receiving a solid material, at least one crushing section for crushing the material supplied from the supplying section, and a discharging section for discharging the material crushed by the crushing section to outside. The at least one crushing section is formed via partitioning by a rotating disk on a side of the supplying section and a rotating disk on a side of the discharging section. The rotating disks are connected to at least one rotating shaft so as to be driven to rotate. The rotating disks are arranged at positions apart from each other in an axial direction. At least one of the rotating disk on the side of the supplying section or the rotating disk on the side of the discharging section is arranged with at least one blade projected from the face thereof. The faces of the rotating disks are opposed to each other and at least one face is formed with a through hole penetrating in the axial direction and at a position proximate to the rotational axis center of the rotating disks and also positioned is at least one portion thereof in a circumferential direction. Material supplied from the supplying section is crushed by a crushing operation produced in accordance with driving to rotate the blade in the crushing section. The supplying section is made to be communicate with the side of the discharging section constituting a downstream side via the through hole formed in the at least one rotating disk.

Regarding the "crushing" of the solid material, "crushing" refers to a processing of simply breaking down the solid material into smaller pieces. Generally, the grain size of a powder may be classified as roughly crushed, intermediately crushed, crushed, finely crushed, and ultra finely crushed.

According to a crushing apparatus of this kind, the airflow needed for causing the solid material received by the supplying section to flow to the side of the discharging section is produced by driving so as to rotate the rotating disk having the blades. Thereby, the solid material is made to successively flow by being borne or carried by the airflow, crushed, and collected. Specifically, the material introduced into the crushing section is crushed by the application of a synergetic crushing force, by being impacted by the rotating disk and the blade that are driven so as to rotate, by being exerted with a tearing shear force, by being stuck so as to impact a portion of a peripheral wall face or the like, or by impacting with other pieces of the material. Additionally, the powder, crushed to have a fine grain size, also has a property of being likely to stay at a position proximate to the rotational axis center.

According to the first aspect of the invention, the solid material supplied to the supplying section is crushed by a crushing operation produced in accordance with driving the blade to rotate within the crushing section. When a through hole is formed in the rotating disk on the side of the supplying section, which disk is used for partitioning in order to form the supplying section and the crushing section, the material supplied from the supplying section is introduced into the crushing section, not from a side of an outer peripheral face of the rotating disk having a significant application of the rotational driving forces, but instead from the through hole disposed at a position proximate to the rotational axis center. That is, the material is taken from the through hole having a small application of rotational force. Therefore, the material can be applied with a gradually increasing crushing force. Further, when the through hole is formed in the rotating disk on the side of discharging section, which disk is used for partitioning so as to form the crushing section and the discharging section, the powder stays at a position proximate to the rotational axis center after having being crushed within the crushing section, and is discharged from the through hole by being borne on the generated airflow. Therefore, the powder can be discharged to the discharging section without being excessively crushed. It is preferable to form the through hole on a radially inner side of a position of arranging the blade of the rotating disk.

Next, according to a second aspect of the invention, in the above-described first aspect of the invention, a plurality of blades is radially arranged on at least one rotating disk by directing a blade face thereof in the rotational direction of the rotating disk along the circumferential direction centering on the rotational axis center. At a position between adjacent blades in the circumferential direction, at least one sub-blade is attachably and detachably arranged following the preceding blade immediately therebefore (in the rotating direction of the rotating disk). A direction of the blade face of the sub-blade is pertinently adjusted relative to the blade face of the preceding blade immediately there before.

According to the second aspect of the invention, the sub-blade rotating immediately after the rotating blade divides the airflow produced in accordance with the rotating blade. Further, in accordance with a dividing operation, the powder in the crushing section is applied with a tearing shear force. Adjusting the direction of the blade face of the sub-blade can adjust the operating force to divide the airflow. For example, when the blade face of the sub-blade and the blade face of the blade are arranged in parallel with each other, the operating force to divide the airflow is significantly applied. Further, when the sub-blade is arranged radially similar to the blade, in comparison with the case of the above-described arrangement, the operating force to divide the airflow is reduced.

Next, according to a third aspect of the invention, a guide disk is arranged in parallel at a position between the rotating disk on the side of the supplying section of the crushing section and the rotating disk on the side of the discharging section in the above-described first and second aspects of the invention. The guide disk is connected to the rotating shaft of one of the rotating disks and driven so as to rotate. The guide disk is formed with a guide face having a shape for guiding the powder in the crushing section to the position of the arrangement of the blades in accordance with driving to rotate the guide disk.

According to the third aspect of the invention, by driving to rotate the guide disk connected to the rotating shaft, the powder in the crushing section is guided to a position where the blade is arranged due to the shape of the guide face formed on the guide disk. Thereby, for example, the powder disposed at a position proximate to the rotational axis center can be efficiently crush processed.

In any one of the above-described first through third aspects of the invention, according to a fourth aspect of the invention, the peripheral wall face of the crushing section is provided with a guide projection having a shape able to guide the powder flowing from an upstream side to the downstream side along the peripheral wall face from the peripheral wall face of the crushing section in an inner direction.

According to the fourth aspect of the invention, the powder flowing from the upstream side to the downstream side along the peripheral wall face of the crushing section is guided from the peripheral wall face of the crushing section to the inner side direction due to the shape of the guide projection. Thereby, the powder disposed at a position of the peripheral wall face of the crushing section can be guided to, for example, a position at which the blade is disposed. As a result, the powder can be efficiently processed to crush.

According to a fifth aspect of the invention, in any one of the above-described first through fourth aspects of the invention, the crushing apparatus is constituted such that the rotating disk on the side of the supplying section and the rotating disk on the side of the discharging section are respectively connected to at least two rotating shafts. Each of the two rotating shafts is driven to rotate so as to produce a relative rotational speed difference. An interactive application of a crushing force is produced by the relative rotational speed difference between the two rotating disks.

Here, as a description of the states for producing the relative rotational speed difference between the plurality of rotating disks, the following states are listed: each rotating disk is rotated in the same direction at different rotational speeds; each rotating disk is rotated in opposing directions; or only one rotating disk rotates while the other is not rotated.

According to the fifth aspect of the invention, the crushing processing in the crushing section is performed due to the application of the crushing force by a single member of the rotating disk, as well as due to the interactive application of the crushing force produced by the relative rotational speed differences between the respective rotating disks. Specifically, when the plurality of rotating disks is rotated in directions different from each other, the application of the crushing force produced by the relative rotational speed difference is promoted. Therefore, a large relative rotational speed difference can be obtained even when the respective rotating disks are rotated at relatively low speeds. Further, if the respective rotating disks are rotated in the same direction at rotational speeds different from each other or when only one side of the rotating disk is rotated, the crushing force is applied gently and efficiently.

According to a sixth aspect of the invention, in any one of the above-described first through fifth aspects of the invention, an outer peripheral edge portion of the rotating disk formed so as to partition the crushing section and the discharging section is attachably and detachably arranged with at least one impact blade having a shape facing a peripheral wall face. The at least one impact blade is disposed on a radially outer side of a disk on a side of the discharging section thereof, on the disk face on the side of the discharging section. A face portion on a radially outer side of the impact blade, opposed to the peripheral wall face, is formed with a plurality of escape grooves along the axial direction wherein each grove has a shape penetrated in a rotational direction of the impact blade.

With regard to the sixth aspect of the invention, the impact blade knocks or grinds so as to crush the powder disposed between the rotating disk, which disk is used to partition and thereby form the crushing section and the discharging section, and the peripheral wall surface disposed on the outer side (in a radial direction of the rotating disk) in accordance with the rotation of the rotating disk. Further, due to the escape grooves formed on the impact blade, a vortex flow produced between the impact blade and the peripheral wall face in accordance with the rotation of the impact blade is allowed to escape from the escape grooves to outside. Thereby, the flowability of the powder can be improved.

Next, according to a seventh aspect of the invention, in any one of the above-described first through sixth aspects of the inventions, the rotating disk, which disk is used for partitioning so as to form the crushing section and the discharging section, is attachably and detachably arranged with a classifying blade having a shape projected toward the side of the discharging section. The powder discharged from a gap between an outer peripheral face of the rotating disk and the peripheral wall face of the crushing section is sorted by a gap between the classifying blades in a rotational state, so as to be discharged to the discharging section. The number of arranging the classifying blades is pertinently adjusted.

Regarding the seventh aspect of the invention, the powder discharged from the gap between the outer peripheral face of the rotating disk, partitioning so as to form the crushing section and the discharging section, and the peripheral wall face of the discharging section is pertinently sorted by the gap between the rotating classifying blades and discharged to the discharging section. The classifying level can be adjusted, for example, by increasing or decreasing the number of the classifying blades attached to the rotating disk.

According to an eighth aspect of the invention, in the above-described seventh aspect of the invention, a wall face of the discharging section is further attachably and detachably arranged with a gap-adjusting member for narrowing the wall face and a portion of the classifying blade on a side of a rotating end thereof. The gap-adjusting member used to adjust the gap to a predetermined dimension is pertinently selected and arranged.

In accordance with the eighth aspect of the invention, the gap-adjusting member adjusts the gap between the classifying blade and the wall face of the discharging section. Therefore, even when the classifying blade is replaced with a classifying blade having a shorter length for example, the gap-adjusting member can still adjust the dimension of the gap.

Additionally, according to a ninth aspect of the invention, in the above-described seventh or eighth aspects of the invention, a through hole is formed at the rotating disk used for partitioning so as to form the crushing section and the discharging section. The classifying blade is attached at a position closer to the rotational axis center than the position for forming the through hole relative to the rotating disk. A classifying section for sorting the powder discharged from the through hole is partitioned so as to form at an outer region in a direction of a rotating radius of the classifying blade. The classifying section is arranged with a classifying cylinder formed in the shape of a cylinder along a position between the classifying blade and the peripheral wall face on the outer side in the direction of the rotating radius of the classifying blade.

According to the ninth aspect of the invention, also the powder discharged from the through hole formed at the rotating disk, which disk is used for partitioning to form the crushing section and the discharging section, is sorted by the classifying blade. Further, by arranging the classifying cylinder between the classifying blade and the peripheral wall face, the flow of the powder in the classifying section can be finely controlled.

Further, according to a tenth aspect of the invention, in the above-described ninth aspect of the invention, the classifying cylinder is connected attachably to and detachably from the peripheral wall face of the classifying section. The classifying cylinder has a shape with an enlarging cylinder diameter from the upstream side to the downstream side, or a shape with a relatively constant cylinder diameter, is pertinently selected and arranged.

With the tenth aspect of the invention, the powder flowing in the classifying cylinder is made to easily flow to the downstream side.

Next, according to an eleventh aspect of the invention, in the above-described ninth or tenth aspect of the invention, the classifying cylinder is arranged attachably to and detachably from the peripheral wall face of the classifying section. The dimension of the gap between the classifying cylinder and the rotating disk used for partitioning to form the crushing section and the discharging section, and the dimension of the gap between the classifying cylinder and the peripheral wall face of the classifying section are pertinently adjusted via the attaching position the classifying cylinder.

Regarding the eleventh aspect of the invention, the flow of the powder can be finely adjusted by adjusting the positional relationship (i.e., the gap dimension) between the classifying cylinder and other members.

According to a twelfth aspect of the invention, in any one of the above-described first through eleventh aspects of the inventions, the through hole is formed in the rotating disk that is used for partitioning so as to form the crushing section and the discharging section. The rotating disk is formed with a thick-walled face portion for applying a resistance against the flow of the powder discharged from the through hole in accordance with the rotating of the rotating disk at a disk face thereof, on a side of the discharging section. A gradually thickening wall thickness shape, gradually increasing toward the inner side in a radial direction, constitutes the thick-walled face portion.

With the twelfth aspect of the invention, a resistance is applied to the flow of the powder discharged from the through hole by the thick-walled face portion. Therefore, for example, the powder, which does not have a desired grain size, can be restrained from being discharged to the discharging section.

Advantage of the Invention

The invention can achieve the following effects by adopting the above-described means.

According to the first aspect of the invention, the crushing accuracy and the product recovery rate can be promoted without deteriorating the material property of the solid material by a simple constitution of forming a through hole in the rotating disk. The described embodiment can also be used as a general purpose machine capable of dealing with the various production modes of many product types, small amounts of production, and the like. For example, when the through hole is formed at the rotating disk on the side of the supplying section, in which the rotating disk is used for partitioning so as to form the crushing section, the solid material introduced into the crushing section can be gently crushed. When the through hole is formed in the rotating disk on the side of the discharging section, the powder crush processed is made to be easily discharged from the through hole. Therefore, the powder is not excessively crushed.

According to the second aspect of the invention, the turbulent airflow having a pertinent intensity can be applied to the interior of the crushing section by dividing the airflow produced by the blade. Therefore, in the crushing processing, a large crushing force is not abruptly applied to the powder. The crushing processing can be efficiently performed.

According to the third aspect of the invention, the crushing processing can be further efficiently carried out by guiding the powder disposed at a position proximate to the rotational axis center in the crushing section to a position where the blade is arranged.

According to the fourth aspect of the invention, the crushing processing can be further efficiently performed by guiding the powder disposed at a position of the peripheral wall face in the crushing section to the inner side in a radial direction of the crushing section. Preferably, constructing a constitution in which the fourth aspect of the invention is combined with the third aspect of the invention further efficiently performs the crushing processing.

According to the fifth aspect of the invention, utilizing the relative rotational speed difference of the rotating disks allows the efficient performance of the crushing processing. Therefore, a large relative rotational speed difference can be achieved without actually rotating the rotating disk at high speeds. The crushing process can efficiently be performed while restraining the influence of heat generated from the rotating disk. Further, the speed of the rotating disk itself can be restrained. Therefore, the crushing processing can be realized without damaging the material property of the crushed material while demonstrating a constant crushing force. The crushing efficiency can be improved without increasing the number of rotating disks. Therefore, the whole structure of the crushing apparatus can be made compact. According to the sixth aspect of the invention, the efficiency of crushing the powder can further be improved.

According to the seventh aspect of the invention, the accuracy of sorting the powder can be simply adjusted.

According to the eighth aspect of the invention, even when the length of the classifying blade is changed or the position of rotating disk is changed in accordance with, for example, a condition of an amount of processing to crush the powder or the like, the gap between the classifying blade and the wall face of the discharging section can be simply adjusted.

According to the ninth aspect of the invention, the sorting accuracy of the powder discharged from the through hole and the efficiency of the crushing process can be improved.

According to the tenth aspect of the invention, the sorting accuracy of the powder discharged from the through hole and the efficiency of the crushing processing can be further improved.

According to the eleventh aspect of the invention, the classifying accuracy of the powder can be further finely adjusted.

According to the twelfth aspect of the invention, the efficiency of crushing the powder can be further improved.

BEST MODE FOR CARRYING OUT THE INVENTION

Embodiments of a best mode for Carrying out the invention will be explained in reference to the drawings as follows.

Embodiment 1

Figure 1:
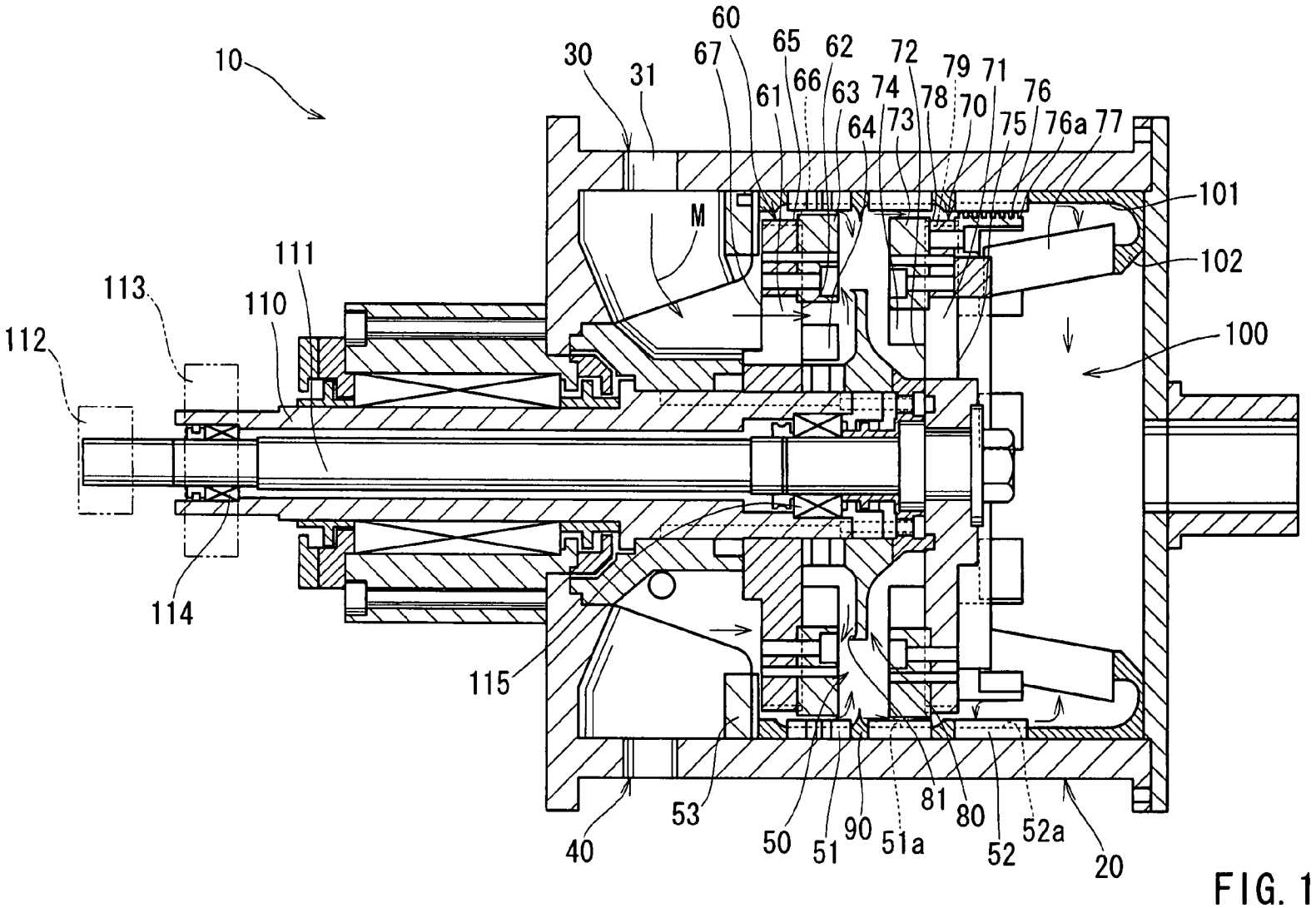
FIG. 1 is a sectional view from a side direction of an inner structure of a crushing apparatus according to embodiment 1.
Figure 2:
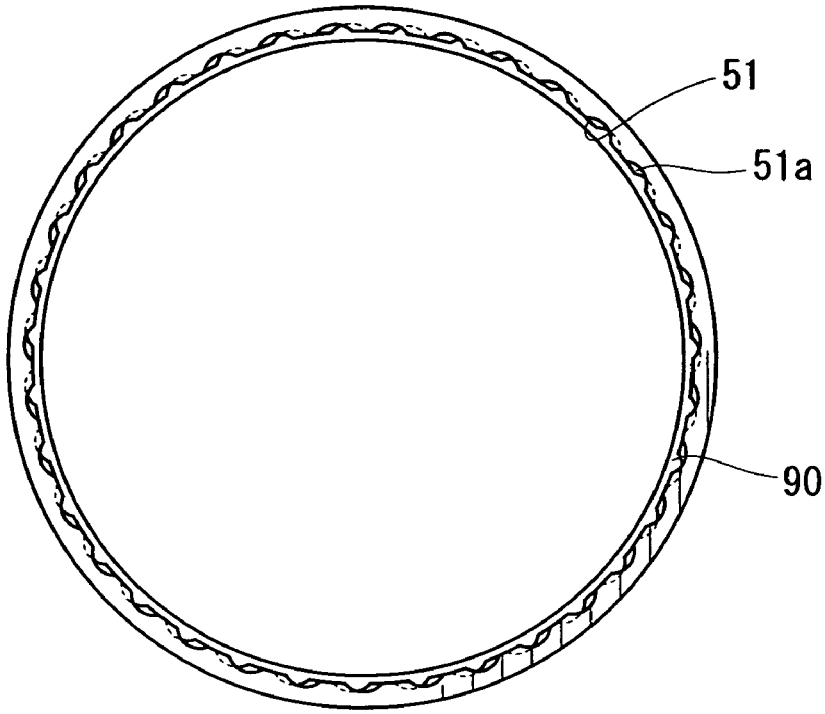
FIG. 2 is a front view of a peripheral wall face.
Figure 3:
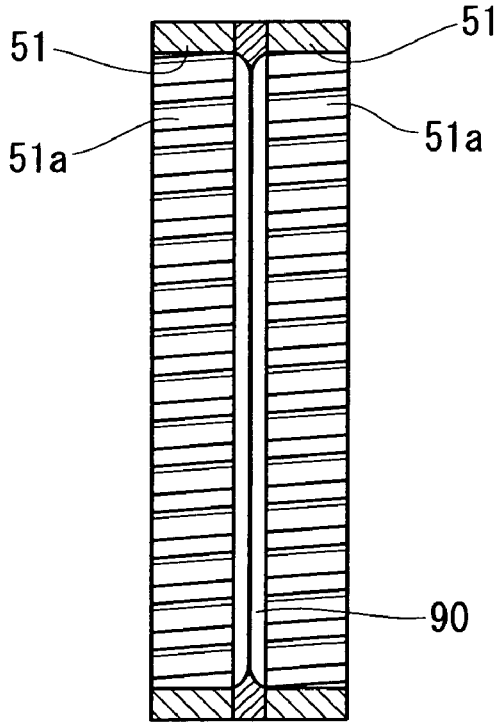
FIG. 3 is a sectional view of FIG. 2 taken from a side direction.
Figure 4:
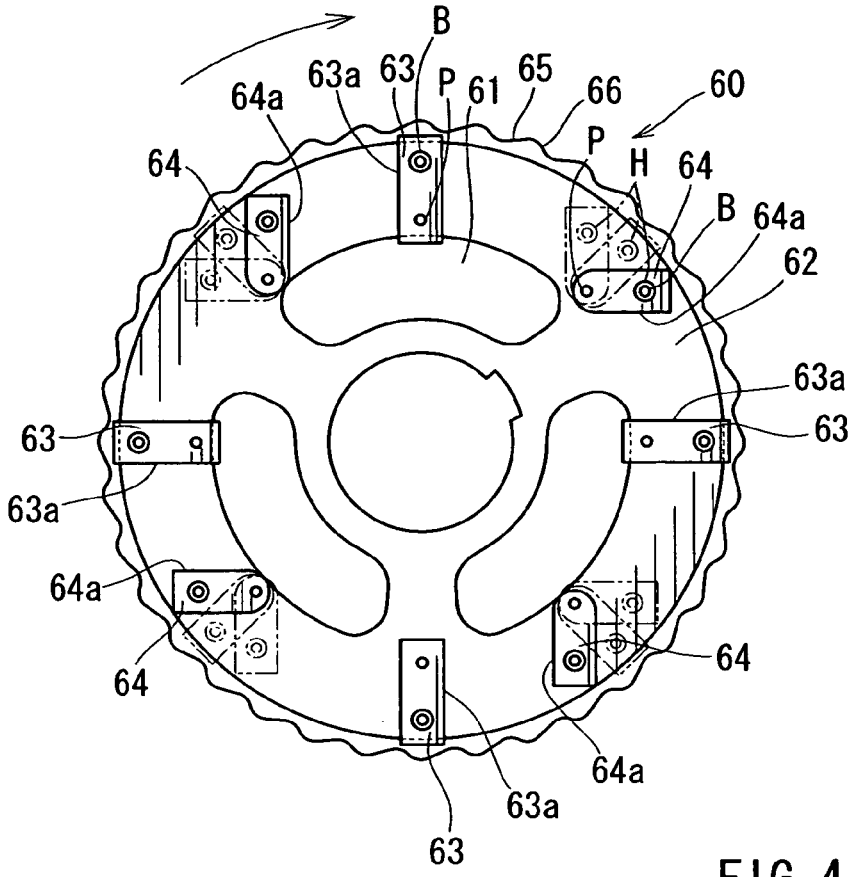
FIG. 4 is a front view of a first rotating disk.
Figure 5:
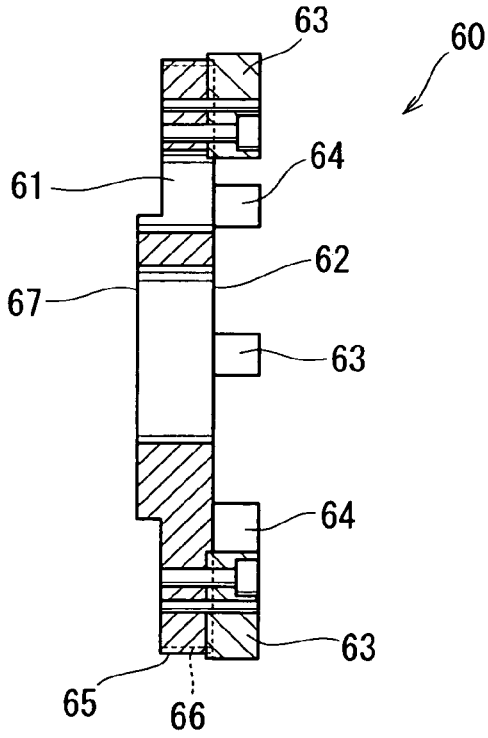
FIG. 5 is a sectional view of FIG. 4 from a side direction.
Figure 6:
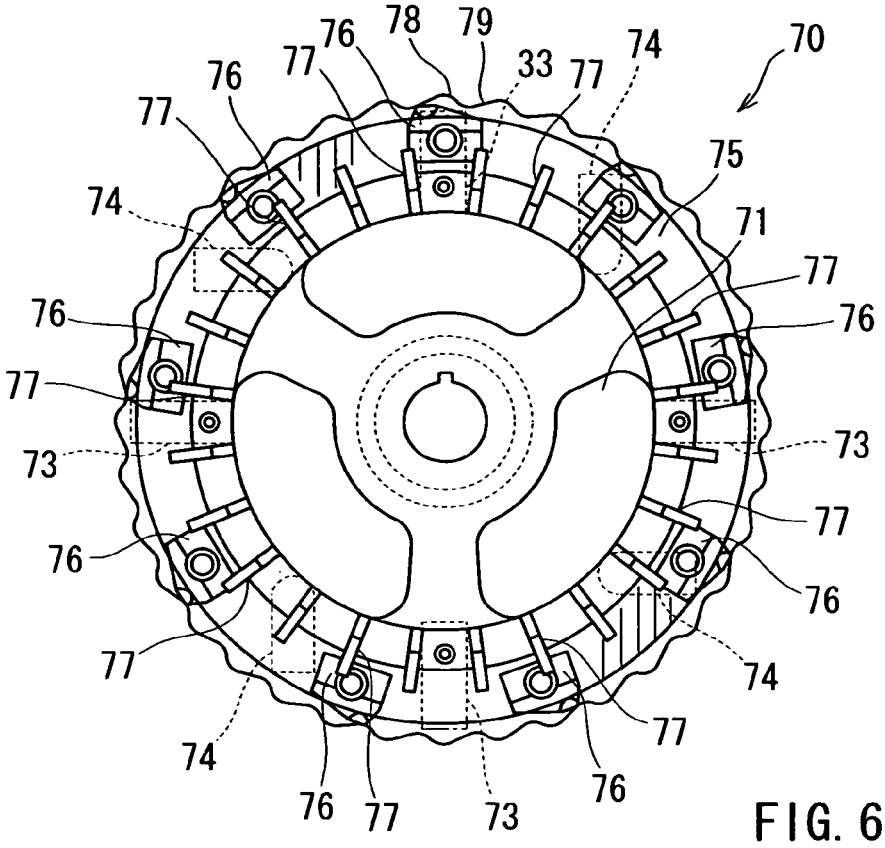
FIG. 6 is a front view of a second rotating disk.
Figure 7:
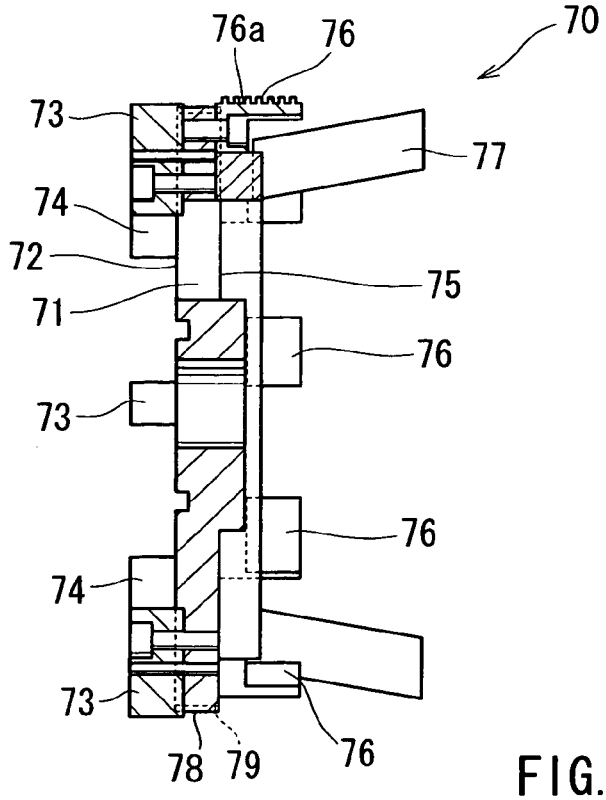
FIG. 7 is a sectional view of FIG. 6 from a side direction.
Figure 8:
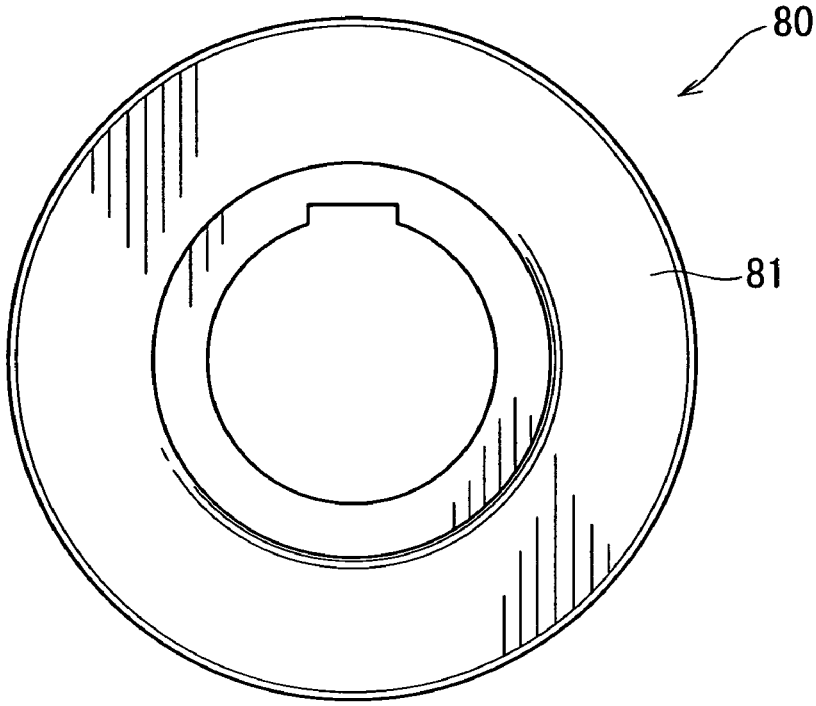
FIG. 8 is a front view of a guide disk.
Figure 9:
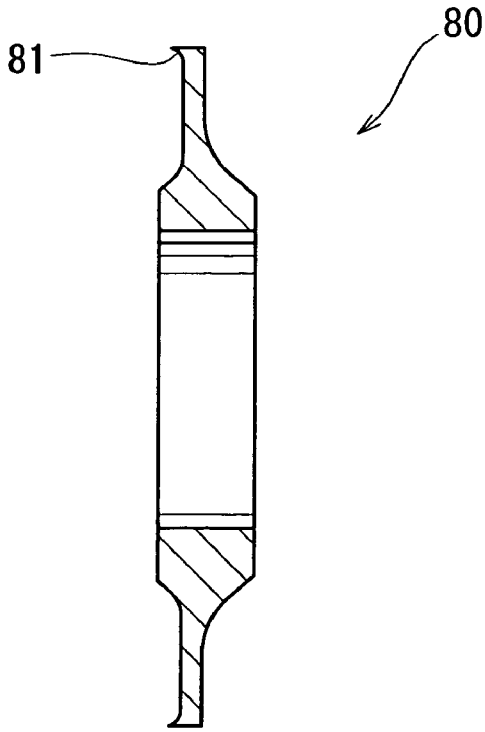
FIG. 9 is a sectional view of FIG. 8 from a side direction.

First, a crushing apparatus 10 of the first representative embodiment will be explained with reference to FIG. 1 through FIG. 9. FIG. 1 is a sectional view of an inner structure of the crushing apparatus 10 from a side direction, FIG. 2 is a front view of a peripheral wall face member 51, FIG. 3 is a sectional view of FIG. 2 from a side direction, FIG. 4 is a front view of a first rotating disk 60, FIG. 5 is a sectional view of FIG. 4 from a side direction, FIG. 6 is a front view of a second rotating disk 70, FIG. 7 is a sectional view of FIG. 6 from a side direction, FIG. 8 is a front view of a guide disk 80, and FIG. 9 is a sectional view of FIG. 8 from a side direction.

The crushing apparatus 10 of this embodiment is constructed such that the entire body is covered with a casing 20, as shown in FIG. 1. Inside of the casing 20 is provided with a supplying section 30 for supplying a solid material M (e.g., a food product in this embodiment), a crushing section 50 for crushing the supplied solid material M, a classifying section (partitioned to form by a classifying blade 77, mentioned later) for classifying a portion of a powder (i.e., solid material M) crushed to a desired grain size, and a discharging section 100 for discharging and collecting the classified powder. Further, the supplying section 30, the crushing section 50, the classifying section, and the discharging section 100 successively communicate with each other.

Additionally, as shown in FIG. 1, a first rotating shaft 110 with a hollow tube configuration is horizontally installed in the center of interior of the crushing apparatus 10 along a width length direction. A second rotating shaft 111 is inserted into the hollow portion of the first rotating shaft 110. The second rotating shaft 111 is provided so as to have the same axis centerline position as that of the first rotating shaft 110. The first rotating shaft 110 and the second rotating shaft 111 are rotatably supported by bearings 114 and 115, provided at predetermined positions in a state in which both rotating shafts can be rotated independently from each other (i.e., a relatively rotatable state). Specifically, a pulley 113 is connected with an end portion of the first rotating shaft 110 and a pulley 112 is connected with an end portion of the second rotating shaft 111. The pulleys 112 and 113 are connected to electric motors (not illustrated) with V belts (also not illustrated) and rotated by transmitted rotational driving forces. Thereby, the first rotating shaft 110 and the second rotating shaft 111 can be freely rotated relative to each other via individual transmissions of the rotational drive forces.

Integrating structures capable of being disassembled and exchanged configure the respective parts constituting the crushing apparatus 10. Therefore, maintenance operations of cleaning the interior of the crushing apparatus 10 for example, or exchanging respective parts with other appropriate parts, can be simply performed. In addition, blades 63 and 73, sub-blades 64 and 74, and an impact blade 76 (mentioned later) are respectively connected attachably to and detachably from a first rotating disk 110 and a second rotating disk 111 via a fastening member such as a screw B (see FIG. 4), or the like. Therefore, the above-described respective blades can be easily used by simply exchanging blades having different shapes, such as different lengths for example, or the like, or by specifically increasing or reducing the number of blades to be arranged in accordance with an object of their use. Thereby, the degree of processing to crush a material can be adjusted in accordance with the conditions of a material property of the material.

Further, respective constitutions of the crushing apparatus 10 will be explained in details.

First, as is shown in FIG. 1, the supplying section 30 includes a material supply port 31 for supplying the solid material M. The interior of the material supply port 31 communicates with the crushing section 50, as will be described later. When the crushing apparatus 10 is operated, the supplying section 30 is provided with airflow in the intake direction through to the discharging section 100. The rotational drive force of the first rotating disk 60 and the second rotating disk 70 operating when the crushing device 10 is driven, and a vacuum force of a suction machine (not illustrated) provided on a side of the discharge section 100, may combine to produce the airflow. As shown in FIG. 1, an area on the upstream side of the crushing section 50 is provided with an intake section 40 that is used for adjusting an intake amount in order to produce a stable airflow. As a result, when the solid material M is fed into the material supply port 31, the solid material M is smoothly introduced into the crushing section 50 by the airflow.

Next, as is also shown in FIG. 1, the first rotating disk 60 and the second rotating disk 70 essentially partition the crushing section 50. The crushing section 50 communicates with the supplying section 30 via the first rotating disk 60. Further, the crushing section 50 communicates with the discharging section 100 via the second rotating disk 70.

The first rotating disk 60 and the second rotating disk 70 are arranged to align in an axial direction of the first rotating shaft 110 and the second rotating shaft 111. In particular, the first rotating disk 60 is integrally connected to the first rotating shaft 110. The second rotating disk 70 is integrally connected to the second rotating shaft 111. Therefore, the first rotating disk 60 and the second rotating disk 70 can be driven to rotate at rotational speeds producing a relative rotational speed difference between the two disks 60 and 70, in accordance with rotational driving of the first rotating shaft 110 and the second rotating shaft 111. According to the embodiment, rotating the first rotating disk 60 in an opposite direction from the second rotating disk 70 produces the relative rotational speed difference. Otherwise, rotating the first rotating disk 60 in the same direction as the second rotating disk 70 but at a different speed than the first rotating disk 60 may also produce the rotational speed difference. Similarly, rotating only the rotating disk on one side may also produce the rotational speed difference.

As is shown in FIG. 4, the first rotating disk 60 is formed with a through hole 61 in the shape of a circular arc at a position proximate to a rotational axis center of the first rotating disk 60. As shown in FIG. 6, the second rotating disk 70 is formed with a through hole 71 in the shape of a circular arc at a position proximate to a rotational axis center of the second rotating disk 70. Although the through holes 61 and 71 are positioned at three locations along a circumferential direction, the sizes and numbers of the through holes 61 and 71 may be particularly set in accordance with an object of use of the crushing apparatus 10.

Here, according to the first rotating disk 60, as shown in FIG. 1, the dimensions of the gap between an upstream side surface 67 of the rotating disk 60 and a side wall face 53 of the crushing section 50, is set to be narrow. Therefore, the solid material M supplied from the supplying section 30 is carried by the airflow and is introduced into the crushing section 50 by flowing through the through hole 61, without flowing through the narrow gap. The powder, after having being processed and crushed in the crushing section 50, is borne on the airflow directed from the crushing section 50 to the discharging section 100. The powder is then discharged to the discharging section 100 by flowing through the through hole 71 of the second rotating disk 70. That is, even when the first rotating disk 60 or the second rotating disk 70 impact the powder, crushed so as to have a small grain size, the powder is not easily influenced by the rotational drive force and therefore tends to stay at a position proximate to the rotational axis center. As a result, the powder, after having been crush processed, flows by being carried by the airflow directed into the through hole 71 of the second rotating disk 70 and is discharged to the discharging section 100.

In particular, according to the first rotating disk 60, as shown in FIG. 4 and FIG. 5, a downstream side surface 62 is arranged with four blades 63. Specifically, these blades 63 are arranged so as to radial center on the first rotating shaft 110 and have a shape projecting towards the second rotating disk 70. The blades 63 produce airflow inside of the crushing section 50 or strike the powder scattered in the crushing section 50 in accordance with the rotational driving force rotating the first rotating disk 60. As shown in FIG. 4, the sub-blades 64 are respectively arranged at positions among the plurality of blades 63 arranged along a circumferential direction. Regarding the sub-blades 64, the blades faces 64*a* of the sub-blades 64 are arranged in directions parallel with the blade faces 63*a* when the first rotating disk 60 is rotated (e.g., the first rotating disk 60 of this example is rotated in the clockwise direction of surface of the paper, as indicated by the arrow in FIG. 4), relative to the orientation of the immediately preceding blade 63. Specifically, the first rotating disk 60 is formed with attaching holes H for adjusting the attaching angle position of each of the sub-blades 64 at a plurality of positions (three orientation positions are shown according to the current embodiment). Therefore, the sub-blades 64 are respectively attached in the above-described directions by being fixed by the screws B at particularly selected positions of the attaching holes H. The sub-blades 64, arranged in such a direction, divide the airflow produced by the corresponding blade 63 proceeding immediately before the sub-blade 64 in accordance with the rotational driving of the first rotating disk 60. Consequently, the sub-blade 64 divides the airflow produced from the blade 63, attenuates the power of the powder when the powder is crushed, and changes the flowing direction of the airflow. Thereby, a turbulent vortex flow can be produced or a vacuum state can be partially produced at the periphery of the first rotating disk 60, or exerting a tearing shear force to the powder can finely crushed the powder. By attaching the sub-blade 64 to another attaching hole H, the direction or orientation the sub-blade 64 can be changed. Thereby, for example, if the sub-blade 64 is radially arranged so as to have the same relative direction as that of the blades 63, the operation of dividing the airflow can be made weaker than in the case of the above-described direction. That is, the sub-blade 64 can be optimally used by particularly adjusting the operation of dividing the airflow in accordance with the conditions of a material property or the like.

Regarding the second rotating disk 70, as shown in FIG. 6 and FIG. 7, pluralities of blades 73 and sub-blades 74 are arranged on an upstream side surface 72. The blades 73 and the sub-blades 74 are arranged in a similar manner to the blades 63 and the sub-blades 64 of the first rotating disk 60, previously described, in order to achieve a similar operation. Therefore, by relatively rotating the first rotating disk 60 to the second rotating disk 70 having the above-described configurations, an even greater turbulent airflow is produced in the crushing section 50. Consequently, the crushing processing can be more efficiently performed. Specifically, the solid material M is crushed via the application of a compression force, a tearing shear force, and a crushing force applied to the solid material M through impacting other solid materials M or through impact of the solid material M with a portion of the peripheral wall face member 51, or the like, of the crushing section 50. The crushing of the solid material M is via the operation of the airflow and an impact force in accordance with the rotational driving of the first rotating disk 60 and the second rotating disk 70. At this time, the powder, which is being crushed processed, is knocked or impacted by the driving rotational forces of the first rotating disk 60 and the second rotating disk 70 so as to widely move about the crushing section 50, while the grain size of the solid material M is relatively large. However, when the first rotating disk 60 or the second rotating disk 70 has impacted the powder, which has become relatively small through crush processing, the rotational driving forces do not easily influence the powder. Therefore, the powder tends to stay at a position proximate to the rotational axis center.

A plurality of impact blades 76 are arranged to a downstream side surface 75 (corresponding to a disk surface on the side of the discharging section of the invention) of the second rotating disk 70. Specifically, the impact blades 76 are arranged radially centering about the second rotating shaft 111. As shown in FIG. 1, each impact blade 76 is connected attachably to and detachably from an outer peripheral edge portion of the second rotating disk 70 and is formed in a shape facing a peripheral wall face member 52. Each impact blade 76 knocks or grinds so as to crush the solid material M disposed between a portion of the impact blade 76 on an outer side (in a radial direction) and the peripheral wall face member 52, in accordance with the rotation thereof. Here, the peripheral wall face member 52 is constructed by a constitution similar to that of the peripheral wall face member 51 (described later) and is formed with a number of groove portions 52*a* in a serration type of shape over an entire periphery thereof. Thereby, a tearing shear force can be applied to the powder impacted by the peripheral wall face member 52. As shown in FIG. 7, a plurality of escape grooves 76*a* are formed at the surface portions on an outer side (in a radial direction) of the impact blades 76, directly opposed to the peripheral wall face member 52. The escape grooves 76*a* are configured with a shape extending in a direction of the rotation of the impact blades 76 and a plurality of the escape groves is arranged so as to align over an axial length direction. Thereby, a vortex flow produced in the groove portion 52*a* of the peripheral wall face member 52 is released from the escape grooves 76*a* to outside in accordance with the rotation of the impact blade 76. Thereby, the flowability of the powder can be improved. Additionally, the impact blades 76 can be exchanged with a corresponding blade having a different shape, such as a different length or the like, or by significantly increasing or decreasing the number or arrangement of the blades in accordance with their purposed use. Thereby, the degree of processing applied to crush the powder can be adjusted to correspond with a condition of a material property or the like.

Next, as is shown in FIG. 1, the guide disk 80 connected to the first rotating shaft 110 is arranged at a position between the first rotating disk 60 and the second rotating disk 70. Particularly, as is shown in FIG. 8 and FIG. 9, the guide disk 80 is formed with a guide face 81 having the shape of a disk at a peripheral edge portion thereof. As is well shown in FIG. 1, the shape of the disk face of the guide face 81 is formed so as to have an outer lip warped back in the shape of a curved face at a radially outer side. Thereby, the powder impacted to the guide disk 80 can be guided to the blade 63 of the first rotating disk 60. Powder disposed at a position proximate to the rotational axis center can be moved to the blade 63 and the crushing processing can be efficiently performed.

Next, as shown in FIG. 1 through FIG. 3, a guide projection 90 is formed around the entire periphery of the crushing section 50 at a position between the first rotating disk 60 and the second rotating disk 70. The guide projection 90 is formed as a projected shape smoothly curved in a ridge type shape extending to an inner side of the crushing section 50. Thereby, the powder flowing from an upstream side to a downstream side (i.e., the left side to the right side as shown in FIG. 1) of the peripheral wall face member 51, or flowing from the downstream side to the upstream side, can be guided toward the interior of the crushing section 50. Consequently, the crushing processing can be efficiently performed.

Each of the peripheral face members 51 respectively arranged on the upstream side and the downstream side of the guide projection 90 is formed with a number of groove portions 51*a* (see FIG. 2 and FIG. 3) in a serration type shape over the entire peripheries thereof. Thereby, a tearing shear force can be applied to the powder impacted by the peripheral wall face member 51. Additionally, as is shown in FIG. 4 and FIG. 6, an outer peripheral face 65 of the first rotating disk 60 and an outer peripheral face 78 of the second rotating disk 70 are also respectively formed with groove portions 66 and 79 over the entire peripheries thereof. As a result, the application of the tearing shear force is improved in accordance with the driving rotation of the rotating disks.

As is shown in FIG. 1 and FIG. 7, regarding the second rotating disk 70, the downstream side surface 75 is arranged with a plurality of classifying blades 77. Specifically, the classifying blades 77 are arranged so as to radially center about the second rotating shaft 111. The classifying blades 77 sort the powder discharged from the gap between the outer peripheral face 78 of the second rotating disk 70 and the peripheral wall face member 51 of the crushing section 50 in accordance with the rotation of the second rotating disk 70. In particular, the classifying blades 77 are adjusted such that the dimensions of the gap between a front end side portion of a classifying blade 77 and a wall face of the discharging section 100 is narrowed by gap-adjusting portions 102 formed on a peripheral wall face member 101. Here, the peripheral wall face member 101 corresponds to a gap-adjusting member of the invention. Consequently, the powder discharged from the gap on the side of the outer peripheral face 78 is sorted by the classifying blades 77, the powder that does not have a desired grain size is blown in a centrifugal direction by the classifying blades 77, and is crushed again, for example, by the impact blades 76. Powder with a desired grain size is only slightly affected by the driving rotational force of the classifying blades 77, and is therefore discharged to the discharging section 100 by being carried by the airflow. The classifying blades 77 can be exchanged with a blade having a different shape, such as the length or the like or particularly increasing or reducing the number or arrangement of the blades in accordance with an object of their use. Further, the length of the classifying blades 77 or the number or arrangement of the classifying blades 77 may be specifically adjusted in accordance with an object of use by exchanging a part, for example, the part itself having a predetermined number of classifying blades 77. Thereby, the degree of processing so as to crush the powder can be adjusted in accordance with a condition of a material property or the like.

The crushing apparatus 10 of the embodiment is constituted as described above. Successively, a method of use of the crushing apparatus 10 will now be explained. In the following explanation, the solid material M flows in directions directed by arrows shown in FIG. 1.

In this description, the solid material M, which is crushed in the representative embodiment, is a food product containing a high level of fat and sugar, such as beans or the like. Additionally, referring to the crushing apparatus 10, the rotational speeds of the first rotating disk 60 and the second rotating disk 70 may be respectively set to about 40 n/sec through 100 m/sec, for example. The first rotating disk 60 and the second rotating disk 70 are driven so as to rotate in different directions than one another.

First, airflow is produced directed to the discharging section 100 from the side of the supplying section 30 by the rotational driving of the first rotating disk 60 and the second rotating disk 70 and by operation of the intake machine.

The solid material M is then supplied to the material supply port 31 of the supplying section 30. The solid material M is introduced into the crushing section 50 by being borne on the airflow. More specifically, the solid material M is introduced into the crushing section 50 by flowing through the through holes 61 of the first rotating disk 60. Thereby, the solid material M is introduced from a location proximate to the rotational axis center (i.e., the through holes 61) at which the driving rotational forces are relatively inconsiderably applied. Consequently, the solid material M is gently crushed without having a large crushing force abruptly applied. The solid materials M do not coalesce by scattering fat or sugar nor do they adhere to the peripheral wall face member 51.

Further, in the crushing section 50, by application of the rotational driving forces of the first rotating disk 60 and the second rotating disk 70, each having respective blades, the solid material M is efficiently and gently crushed. In particular, the first rotating disk 60 and the second rotating disk 70 are respectively driven to rotate at significant rotational speeds. Therefore, heat generation is inconsiderable. On the other hand, the first rotating disk 60 and the second rotating disk 70 are rotated so as to create a relative rotational speed difference therebetween. Additionally, airflows produced by the blades 63 and 73 are divided by the sub-blades 64 and 74 in order to produce a turbulent airflow in the crushing section 50. Still further, the guide disk 80 and the guide projection 90 guide the powder moving in the crushing section 50 in order to have the powder efficiently crush processed.

Since the crush processed powder is liable to stay at a position proximate to the rotational axis center, the powder is introduced into the through holes 71 of the second rotating disk 70 by the airflow and the powder is subsequently discharged to the discharging section 100. The classifying blades 77 sort the powder discharged from the gap between the outer peripheral face 78 of the second rotating disk 70 and the peripheral wall face member 51 of the crushing section 50. As a result, the powder with a desired grain size is discharged to the discharging section 100. In addition, the powder that does not have a desired grain size is crush processed again to constitute the desired grain size and is thereafter discharged.

The powder discharged to the discharging section 100 is collected.

In this way, the crushing apparatus 10 of the present embodiment can introduce solid material M supplied from the supplying section 30 to the through hole 61, at which point the application of the driving rotational forces are relatively small. Therefore, the solid material M can be gently crushed without deteriorating the material properties of the solid material M. The powder, crush processed to the desired grain size, preferably can be discharged from the through hole 71 of the second rotating disk 70 on the downstream side. Therefore, the powder crushed processed to the desired grain size can be swiftly discharged. Consequently, the crushing accuracy and the product recovery rate can be promoted without deteriorating the material property.

A turbulent airflow can be produced in the crushing section 50 through the influence of the respective blades arranged at the first rotating disk 60 and the second rotating disk 70. Thereby, an efficient crushing processing can be achieved without abruptly applying a large crushing force to the powder during the crushing process.

The powder can be efficiently crush processed by the guide disk 80 and the guide projection 90.

In addition, a high crushing efficiency can be achieved even when the first rotating disk 60 and the second rotating disk 70 are not rotated at high speeds. For example, even when the solid material M, which is likely to be effected by the influence of generated heat, is crush processed, the crushing process can be efficiently carried out without deteriorating the material properties of the solid material M. The crushing apparatus 10 can therefore be used as a general purpose machine capable of dealing with various production modes of many product types, small amount type production, and the like.

It is preferable to use the respective parts of the classifying blades 77 and the like, since a number or arrangement of the respective parts can be adjusted or the respective parts can be interchanged in accordance with a particular object of use. Further, the gap-adjusting member 102 can adjust the dimensions of the gap of the classifying blades 77. Therefore, even when the positions of the arrangement of the second rotating disk 70 are changed or the lengths of the classifying blades 77 are changed, the respective parts can preferably deal with the changes.

Embodiment 2

Figure 10:
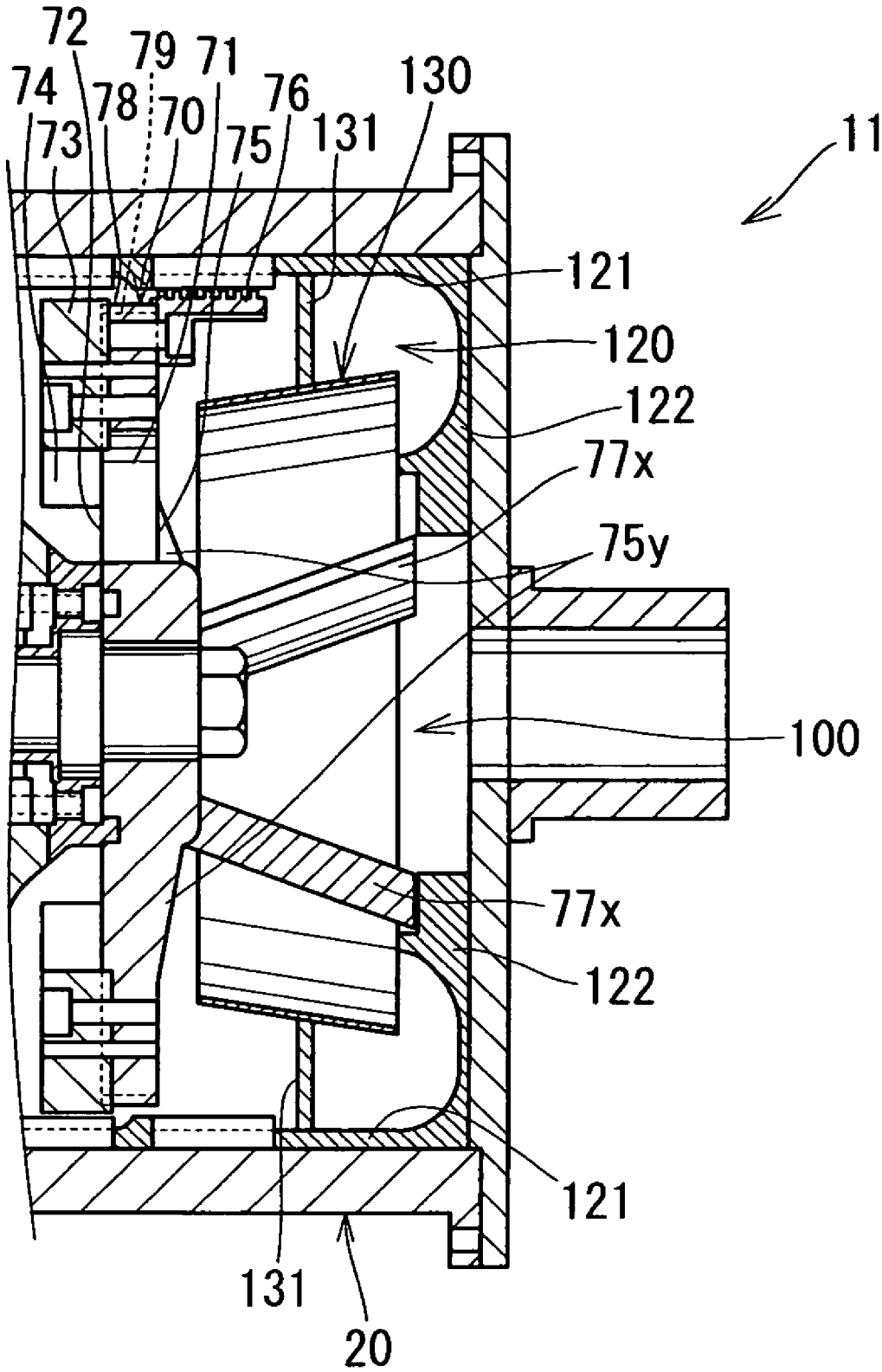
FIG. 10 is a sectional view of a part of an inner structure of a crushing apparatus according to embodiment 2 taken from a side direction.
Figure 11:
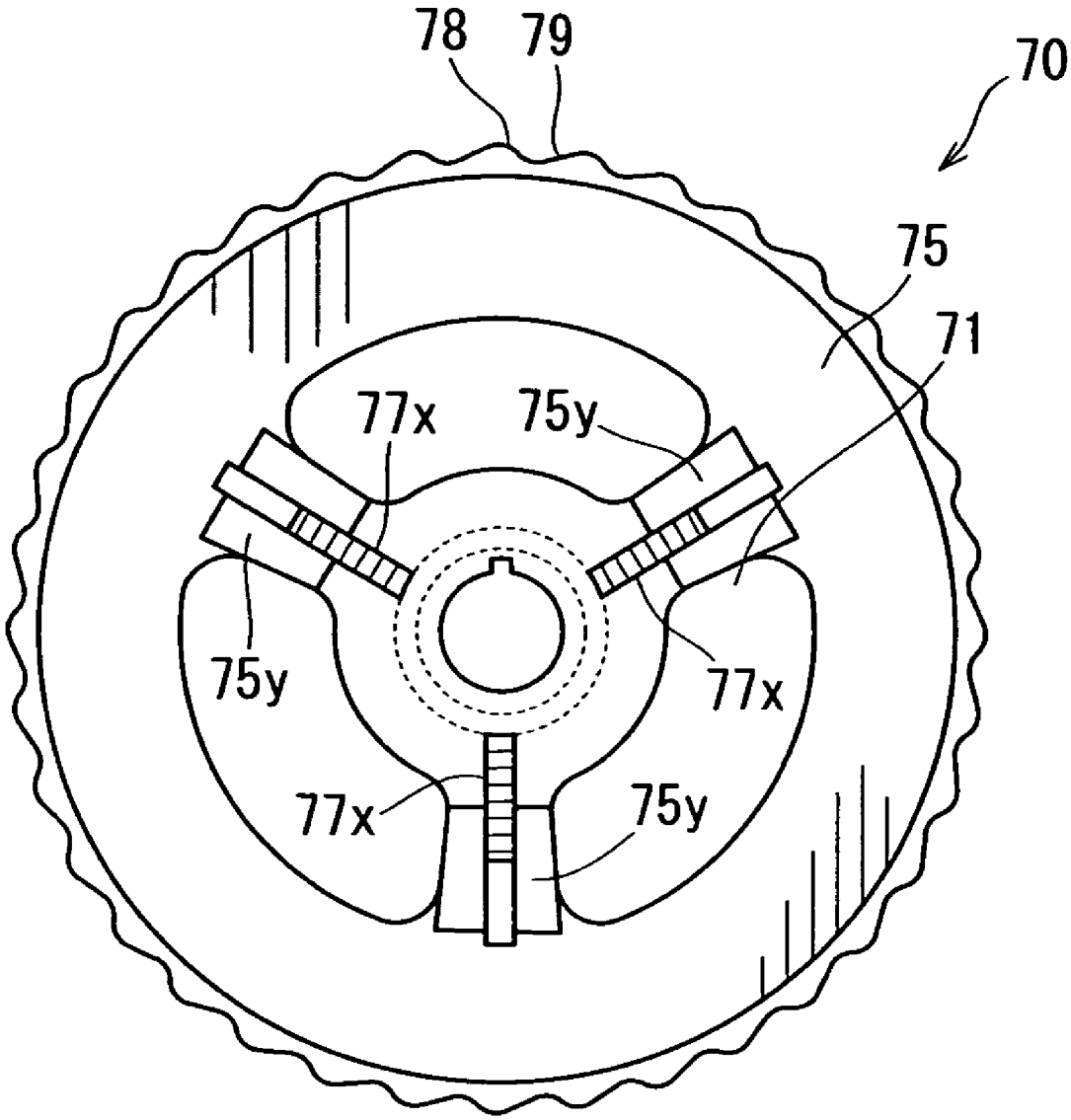
FIG. 11 is a front view of a second rotating disk.

A crushing apparatus 11 of Embodiment 2 will be explained with reference to FIG. 10 and FIG. 11. FIG. 10 is a sectional view showing a portion of an inner structure of a crushing apparatus 11 from a side direction. FIG. 11 is a front view of the second rotating disk 70. Additionally, in the current embodiment, components and elements having a constitution and operation similar to those of the crushing apparatus 10 of Embodiment 1 are provided with the same reference numerals and an explanation thereof may be omitted. Configurations and constitutions different therefrom are provided with different reference numerals and a detailed explanation will be given concerning these constitutions. In the explanation, regarding the components and configurations that are not specifically shown in FIG. 10 and FIG. 11, refer to FIG. 1 through FIG. 9 of Embodiment 1 to identify the constitutions having the stated reference numerals.

According to the crushing apparatus 11 of the present embodiment, as shown in FIG. 10, a constitution of sorting the powder discharged on the downstream side of the second rotating disk 70 differs from that of the crushing apparatus 10 (refer to FIG. 1) shown in Embodiment 1. Specifically, classifying blades 77*x*, arranged at the downstream side surface 75 (i.e., corresponding to the disk face on the side of the discharging section of the present invention) of the second rotating disk 70, are arranged at locations different from that of the classifying blades 77 shown in Embodiment 1. In addition, a classifying section 120 is formed through partitioning by the classifying blades 77*x* in a space on the downstream side of the second rotating disk 70. The classifying section 120 is arranged with a classifying cylinder 130. Additionally, the downstream side surface 75 of the second rotating disk 70 is formed with a thick-walled face portion 75*y* having a partially thick-walled shape.

The above construction will be described in detail below.

First, the classifying blades 77*x* are attached to positions proximate to the rotational axis center of the second rotating disk 70. The classifying blades 77*x* are formed with a shape of gradually enlarging a rotating radius thereof to a gap-adjusting member 122. In particular, as shown in FIG. 11, the classifying blades are attached to a position on a root side of the through hole 71 and are arranged such that the powder discharged from the through hole 71 is discharged to an outer side (in a direction of the rotating radius) of the classifying blades 77*x*, as is shown in FIG. 10. Thereby, the powder discharged from the through hole 71 is sorted by the classifying blades 77*x*. Although three classifying blades 77*x* are arranged in the circumferential direction of the second rotating disk 70 as shown in FIG. 11, the number of classifying blades 77 can be specifically increased, for example, to six or eleven blades. Consequently, the classifying accuracy can be adjusted.

As shown in FIG. 10, the classifying blades 77*x* are extended to the position of the gap-adjusting member 122 provided at a peripheral wall face 121 of the classifying section 120. Thereby, the classifying section 120 is partitioned to be form on the outer side (in the direction of the rotating radius) of the classifying blades 77*x*. A narrow gap is provided between a front-end side portion of the classifying blades 77*x* and the gap-adjusting member 122.

Next, as shown in FIG. 11, the thick-walled face portions 75*y* are respectively formed at positions among the respective through holes 71, formed in the second rotating disk 70. In particular, referring to the thick-walled face portions 75*y*, as shown in FIG. 10, the wall thickness thereof is formed in a shape being thickened linearly to an inner side in the radius direction of the second rotating disk 70. The thick-walled face portions 75*y* produce an airflow directed to the outer side (in the radial direction) in accordance with the rotation of the second rotating disk 70. The airflow functions as a resistance to the flow discharged from the through hole 71 to the classifying section 120. That is, a resistance force for blocking the through hole 71 is applied. Thereby, the amount of the powder discharged from the through hole 71 can be controlled. For example, powder without the desired grain size can be restricted such that the powder is not discharged to the discharging section.

Further, the shape of the thick-walled face portions 75*y* is not limited to the shape by which the wall thickness is changed linearly. The shape may be provided in, for example, the shape of a curved face or the shape of steps.

Next, as shown in FIG. 10, the classifying cylinder 130 is formed in a shape of a cylinder covering the outer side, in the direction of the rotating radius, of the classifying blades 77*x*. Particularly, the classifying cylinder 130 is formed as a tapered cylinder with a diameter gradually enlarging from an upstream side to a downstream side (i.e., from the left side to the right side as shown in FIG. 10). The classifying cylinder 130 is arranged to respectively maintain constant gaps between the classifying cylinder 130 and the second rotating disk 70, the classifying blades 77*x*, and the peripheral wall face 121 of the classifying section 120. The classifying cylinder 130 is integrally mounted onto the peripheral wall face 121 of the classifying section 120 via the support members 131. Further, the support members 131 are partially attached to a plurality of locations of the classifying cylinder 130 and are configured with a shape that does not block the flow of the powder moving on the outer side of the classifying cylinder 130. Various classifying cylinders 130 may be configured having modes in which the respective gap dimensions differ and are variously set. The classifying cylinder 130 can then be exchanged for a specifically selected one to use. Consequently, the respective gap dimensions and the classifying accuracy can be pertinently adjusted. For example, the classifying cylinder 130 may be provided with attaching holes at a plurality of positions thereof to thereby enable the adjustment of the attaching position of the classifying cylinder 130.

The classifying cylinder 130 is provided between the classifying blades 77*x* and the peripheral wall face 121. The classifying cylinder 130 is arranged as a partition to reduce the shape of the space between the classifying blades 77*x* and the peripheral wall face 121. Thereby, the flow of the powder moving in the classifying section 120 can be finely controlled. The classifying blades 77*x* are configured with a shape wherein the cylinder diameter enlarges from the upstream side to the downstream side. Therefore, the powder flowing in the classifying cylinder 130 is made to easily flow to the downstream side.

A method of using the crushing apparatus 11 of the present embodiment will be explained in the following.

First, the discharge amount of the powder discharged from the through holes 71, formed in the second rotating disk 70, is pertinently restricted in accordance with the rotation of the thick-walled face portion 75*y*. Therefore, for example, the powder, in a state prior to reaching the desired grain size, can be retained in the crushing section 50 and the crushing process can continue to be efficiently performed. The powder discharged from a gap on the side of the outer peripheral face and the through holes 71 of the second rotating disk 70, enters the classifying section 120 and is processed so as to be sorted by the classifying blade 77*x* and the classifying cylinder 130. That is, the processing of crushing and the processing of classifying the powder can be efficiently performed.

In this way, according to the crushing apparatus 11 of the embodiment, the classifying accuracy and the efficiency of the crushing processing of the powder discharged from the through hole 71 can be promoted. Still further, the classifying accuracy of the powder can be precisely controlled.

Although the embodiments of the present invention have been explained with regard to the two examples as described above, it is also possible to perform the present invention with various configurations in addition to the above-described embodiments.

For example, although in Embodiment 1 and Embodiment 2, a constitution is shown with a plurality of rotating disks, a constitution having only one rotating disk is also applicable. A constitution is shown with through holes respectively at both rotating disks. However, a constitution in which the through holes are formed on only one of the rotating disks can also be used. In this case, material introduced into the crushing section is abruptly applied with a large crushing force or made to be easily crushed excessively in the crushing section and therefore, caution is required with this alternative.

In Embodiment 1, a constitution is shown of driving to rotate the first rotating disk 60 and the second rotating disk 70 in directions that different from each other. However, it is also possible to rotate the first rotating disk 60 and the second rotating disk in the same direction but at different rotational speeds, or to rotate only one of the rotating disks while the other remains stationary. That is, the crushing processing may be performed so as to restrain the effects of the relative rotational speed difference in accordance with the material property.

The crushing apparatus is shown as being placed horizontally for use. However, the crushing apparatuses 10 and 11 may be placed vertically such that the discharging section is disposed on the upper side of the apparatuses and may be used by setting the direction of rotating the rotating disk to be orthogonal to the direction of the application of a gravitational force. Thereby, the rotating disk driven to rotate is only slightly affected by the force of gravity and the rotational state is further stabilized.

Although a constitution is shown of forming the crushing section 50 through partitioning with two rotating disks, for example, the first rotating disk 60 and the second rotating disk 70, the crushing apparatus may be constructed using a constitution in which a plurality of crushing sections are formed. This may be accomplished by elongating the width length of the casing and the peripheral wall face of the crushing apparatus and by arranging a third rotating disk in parallel, connecting the third rotating disk to the first rotating shaft or the like. Further, a third rotating shaft for connecting to the third rotating disk may be separately provided.

Further, in Embodiment 2 the classifying cylinder 130 is shown with a shape such that the cylinder diameter is enlarged from the upstream side to the downstream side. However, a classifying cylinder 130 may be used having a shape in which the cylinder diameter stays constant or is contracted, in accordance with a condition of a material property or the like. In the case of using a type of the cylinder in which the diameter contracts to the downstream side, the flowability of the powder may be reduced and therefore, caution is required.

The invention claimed is:

1. A crushing apparatus comprising:

a supplying section for receiving a solid material;

at least one crushing section for crushing the material supplied from the supplying section; and a discharging section for discharging the material crushed by the crushing section to outside;

wherein the at least one crushing section is defined between a rotating disk on a side of the supplying section and a rotating disk on a side of the discharging section, the rotating disks being connected to at least one rotating shaft to be driven to rotate and arranged at positions spaced apart from each other in an axial direction;

wherein at least one of the rotating disk on the side of the supplying section and the rotating disk on the side of the discharging section is arranged with at least one blade projected from a face thereof and is formed with at least one through hole penetrated in the axial direction at a position proximate to a rotational axis center of the rotating disk;

wherein the material supplied from the supplying section is crushed as the blade in the crushing section is driven to rotate and the material is discharged to the side of the discharging section on a downstream side of the crushing section via the at least one through hole formed at the at least one rotating disk;

wherein a guide disk is positioned in parallel to and between the rotating disks and is connected to the rotating shaft of one of the rotating disks so as to rotatably driven, and wherein the guide disk is formed with a guide face having a shape to guide a powder produced in the crushing section toward the blade as the guide disk rotates.

2. The crushing apparatus according any one of claim 1, herein a peripheral wall face of the crushing section is provided with a guide projection having a shape constructed and arranged for guiding the powder along the peripheral wall face from the peripheral wall face to an inner side of the crushing section as the powder flows from an upstream side to a downstream side of the crushing section.

3. The crushing apparatus according claim 1, constituted such that the rotating disk on the side of the supplying section and the rotating disk on the side of the discharging section are respectively connected to at least two rotating shafts driven to rotate by producing a relative rotational speed difference and an interactive application of a crushing force is produced by the relative rotational speed difference between the two rotating disks.

4. The crushing apparatus according claim 1, wherein an outer peripheral edge portion of the rotating disk formed to partition the crushing section and the discharging section is attachably and detachably arranged with at least one impact blade constructed and arranged to face a peripheral wall face of the crushing section, the at least one impact blade being disposed on an outer side in a radius direction of a disk face of the rotating disk on a side of the discharging section, and a face portion on an outer side in a radius direction of the impact blade opposed to the peripheral wall face is formed with a plurality of escape grooves having a shape penetrated in a rotational direction thereof along the axial direction.

5. The crushing apparatus according claim 1, wherein the rotating disk for partitioning so as to form the crushing section and the discharging section is attachably and detachably arranged with a classifying blade having a shape projected to a side of the discharging section, and the powder discharged from a gap between an outer peripheral face of the rotating disk and the peripheral wall face of the crushing section is constituted to be sorted from a gap between the classifying blades in a rotational state to be discharged to the discharging section, and the number of the classifying blades can be selectively changed.

6. The crushing apparatus according to claim 5, wherein a wall face of the discharging section is further attachably and detachably arranged with a gap-adjusting member for narrowing the wall face and a portion of the classifying blade on a side of a rotating end thereof, and the gap-adjusting member for adjusting the gap to a predetermined dimension is pertinently selected to arrange.

7. The crushing apparatus according to claim 5, wherein a through hole is formed at the rotating disk used for partitioning in order to form the crushing section and the discharging section;

wherein the classifying blade is attached at a poison more proximate to the rotational axis center than a position of forming the through hole relative to the rotating disk, and a classifying section for classifying the powder discharged from the through hole is partitioned to form at an outer region in a direction of a rotating radius of the classifying blade; and wherein the classifying section is arranged with a classifying cylinder formed in a shape of a cylinder along a position between the classifying blade and the peripheral wall face on the outer side in the direction of the rotating radius of the classifying blade.

8. The crushing apparatus according to claim 7, wherein the classifying cylinder is arranged attachably and detachably to and from the peripheral wall face of the classifying section, and the classifying cylinder has a shape of enlarging cylinder diameter from the upstream side to the downstream side, or a shape of constant cylinder diameter.

9. The crushing apparatus according to claim 7, wherein the classifying cylinder is arranged attachably and detachably to and from the peripheral wall face of the classifying section, and a dimension of a gap between the classifying cylinder and the rotating disk for partitioning to form the crushing section and the discharging section and a dimension of a gap between the classifying cylinder and the peripheral wall face of the classifying section are pertinently adjusted by a position of attaching the classifying cylinder.

10. The crushing apparatus according to claim 1, wherein the through hole is formed at the rotating disk for partitioning to form the crushing section and the discharging section; and wherein the rotating disk is formed with a thick-walled face section for applying a resistance against a flow of the powder discharged from the through hole in accordance with rotating the rotating disk at a disk face thereof on a side of the discharging section, and the thick-walled face portion is constituted by a shape of gradually thickening a wall thickness thereof gradually to an inner side in a radius direction.

11. The crushing apparatus according to claim 1, wherein the at least one rotating disk is formed with a plurality of the through holes arranged in the circumferential direction.

12. A crushing apparatus comprising:

a supplying section for receiving a solid material;

at least one crushing section for crushing the material supplied from the supplying section; and a discharging section for discharging the material crushed by the crushing section to outside;

wherein the at least one crushing section is defined between a rotating disk on a side of the supplying section and a rotating disk on a side of the discharging section, the rotating disks being connected to at least one rotating shaft to be driven to rotate and arranged at positions spaced apart from each other in an axial direction;

wherein at least one of the rotating disk on the side of the supplying section and the rotating disk on the side of the discharging section is arranged with at least one blade projected from a face thereof opposed to each other and formed with a through hole penetrated in the axial direction at a position proximate to a rotational axis center of the rotating disk;

wherein the material supplied from the supplying section is crushed as the blade in the crushing section is driven to rotate and the material is discharged to the side of the discharging section on a downstream side of the crushing section via the at least one through hole formed at the at least one rotating disk; and wherein a plurality of the blades are arranged in a circumferential direction about the rotational axis of the at least one rotating disk, each of the blades having a blade face directed in the rotational direction of the at least one rotating disk;

wherein at a position between the blades contiguous to each other in the circumferential direction, at least one sub blade is attachably and detachably arranged following the preceding blade immediately therebefore in the rotating direction of the rotating disk, and wherein a direction of the blade face of the sub-blade relative to the blade face of the preceding blade immediately therebefore can be selectively adjusted to any of different directions.

13. The crushing apparatus according to claim 12, wherein a peripheral wall face of the crushing section is provided with a guide projection having a shape capable of guiding the powder along the peripheral wall face from the peripheral wall face to an inner side of the crushing section as the powder flows from an upstream side to a downstream side of the crushing section.

14. The crushing apparatus according to claim 12, constituted such that the rotating disk on the side of the supplying section and the rotating disk on the side of the discharging section are respectively connected to at least two rotating shafts driven to rotate by producing a relative rotational speed difference and an interactive application of a crushing force is produced by the relative rotational speed difference between the two rotating disks.

15. The crushing apparatus according to claim 12, wherein an outer peripheral edge portion of the rotating disk formed to partition the crushing section and the discharging section is attachably and detachably arranged with at least one impact blade constructed and arranged to face a peripheral wall face of the crushing section, the at least one impact blade being disposed on an outer side in a radius direction of a disk face of the rotating disk on a side of the discharging section, and a face portion on an outer side in a radius direction of the impact blade opposed to the peripheral wall face is formed with a plurality of escape grooves having a shape penetrated in a rotational direction thereof along the axial direction.

16. The crushing apparatus according to claim 12, wherein the rotating disk for partitioning so as to form the crushing section and the discharging section is attachably and detachably arranged with a classifying blade having a shape projected to a side of the discharging section, and the powder discharged from a gap between an outer peripheral face of the rotating disk and the peripheral wall face of the crushing section is constituted to be sorted from a gap between the classifying blades in a rotational state to be discharged to the discharging section, and the number of the classifying blades can be selectively changed.

17. The crushing apparatus according to claim 12, wherein the through hole is formed at the rotating disk for partitioning to form the crushing section and the discharging section; and wherein the rotating disk is formed with a thick-walled face section for applying a resistance against a flow of the powder discharged from the through hole in accordance with rotating the rotating disk at a disk face thereof on a side of the discharging section, and the thick-walled face portion is constituted by a shape of gradually thickening a wall thickness thereof gradually to an inner side in a radius direction.

18. The crushing apparatus according to claim 12, wherein the at least one rotating disk is formed with a plurality of the through holes arranged in the circumferential direction.

* * * * *